US009607595B2

(12) United States Patent
Ercolano et al.

(10) Patent No.: US 9,607,595 B2
(45) Date of Patent: Mar. 28, 2017

(54) SYSTEM AND METHOD FOR CREATION OF MUSICAL MEMORIES

(71) Applicants: Matteo Ercolano, Venice (IT); Marco Guarise, Venice (IT); Jessica Trahan, Montréal (CA); Giulia Di Natale-Boato, Venice (IT); Ivan Turchetti, Catania (IT); Francesco Pistellato, Venice (IT); Federico Bagato, Padua (IT); Cristina Zardetto, Treviso (IT); Alberto Canova, Venice (IT)

(72) Inventors: Matteo Ercolano, Venice (IT); Marco Guarise, Venice (IT); Jessica Trahan, Montréal (CA); Giulia Di Natale-Boato, Venice (IT); Ivan Turchetti, Catania (IT); Francesco Pistellato, Venice (IT); Federico Bagato, Padua (IT); Cristina Zardetto, Treviso (IT); Alberto Canova, Venice (IT)

( * ) Notice: Subject to any disclaimer, the term of this patent is extended or adjusted under 35 U.S.C. 154(b) by 0 days.

(21) Appl. No.: 14/874,437

(22) Filed: Oct. 4, 2015

(65) Prior Publication Data

US 2016/0098980 A1 Apr. 7, 2016

Related U.S. Application Data

(60) Provisional application No. 62/060,604, filed on Oct. 7, 2014.

(51) Int. Cl.
*G10H 7/00* (2006.01)
*G10H 1/00* (2006.01)

(52) U.S. Cl.
CPC ..... *G10H 7/002* (2013.01); *G10H 1/0025* (2013.01); *G10H 7/008* (2013.01);
(Continued)

(58) Field of Classification Search
CPC ..... G10H 1/0025; G10H 2240/085; G10H 2210/125; G10H 2220/371;
(Continued)

(56) References Cited

U.S. PATENT DOCUMENTS 4,883,067 A * 11/1989 Knispel ..... A61B 5/0482 600/28
7,732,697 B1 * 6/2010 Wieder ..... G10H 1/0025 84/609

(Continued)

*Primary Examiner* — Jeffrey Donels

(57) ABSTRACT

A music generating system comprising sensors configured to acquire data sets related to physiological and environmental condition of a user and a computing device comprising a processor and a memory. The computing device is configured to read, by a data acquisition module, the data sets received from the sensors, to perform, by a data analysis module, a value range analysis of the data sets received to normalize the data sets, to map, with the help of the data analysis module, each of the normalized data sets to families of sounds stored in a data store, to create, by the data analysis module, individual music pieces on the basis of a time series analysis and a frequency analysis of the normalized data sets mapped to the families of sounds and to merge, by a music generation module, the individual music pieces to create a final piece of music.

20 Claims, 2 Drawing Sheets

(52) U.S. Cl.
CPC .. *G10H 2210/021* (2013.01); *G10H 2210/111* (2013.01); *G10H 2210/125* (2013.01); *G10H 2220/351* (2013.01); *G10H 2220/371* (2013.01); *G10H 2240/085* (2013.01)

(58) Field of Classification Search
CPC ..... G10H 2220/351; G10H 2210/111; G10H 7/002; G10H 7/008; G10H 2210/021
USPC ..... 84/609
See application file for complete search history.

(56) References Cited

U.S. PATENT DOCUMENTS 8,222,507 B1 * 7/2012 Salazar ..... G10H 1/0008 84/602
8,229,935 B2 * 7/2012 Lee ..... G10H 1/0008 707/754
9,330,680 B2 * 5/2016 Kassam ..... G10L 25/48
2002/0130898 A1 * 9/2002 Ogawa ..... G06F 17/30017 715/727
2007/0060327 A1 * 3/2007 Curtis ..... A63F 13/10 463/29
2008/0250914 A1 * 10/2008 Reinhart ..... G10H 1/0025 84/645
2008/0257133 A1 * 10/2008 Sasaki ..... G10H 1/0025 84/604
2013/0038756 A1 * 2/2013 Cheng ..... H04N 21/42201 348/231.99
2013/0283303 A1 * 10/2013 Moon ..... G06Q 10/00 725/10
2014/0074479 A1 * 3/2014 Kassam ..... G10H 1/0025 704/270
2015/0339300 A1 * 11/2015 Stoddard, II ..... G06F 17/30038 707/740
2016/0086089 A1 * 3/2016 Ritchie ..... G06N 5/04 706/11

* cited by examiner

SYSTEM AND METHOD FOR CREATION OF MUSICAL MEMORIES

CROSS-REFERENCE TO RELATED APPLICATION

This application claims the benefit of U.S. Provisional Application No. 62/060,604 entitled "A SYSTEM AND METHOD FOR CREATION OF MUSICAL MEMORIES" filed on Oct. 7, 2014, the contents of which are incorporated herein by reference.

FIELD OF THE INVENTION

The present invention relates to a system and method for creation of music. More particularly, the present invention relates to a system and method for creation of music based on data acquired corresponding to physiological, emotional and surrounding environmental states of a person.

BACKGROUND OF THE INVENTION

Every kind of experience gets stored into a person's memory. Some of these memories are short lived while others stay with a person lifelong. In many cases, memory of an experience becomes alive in mind when a person comes across a similar kind of situation. For example, when an adult person visits the school he/she attended as a kid, many of his/her memories become alive. In another example, when a person looks at a photograph of a place he/she took while on vacation along with friends/family long ago, the memory of the vacation comes to mind. Music can act as a strong trigger to bring back memories of sweet/bitter experiences. Most of the people would be able to associate an experience with a piece of music if that music was played while experiencing the situation. So, music and memories have a strong correlation.

Accordingly, there is need in the art for a system and method which can help people relive the memories of experiences with the help of music. Also, there is a need in the art for a system and method through which people can share their emotion felt during an experience on social media by means of sharing pieces of music created based on the experience.

OBJECTS OF THE INVENTION

An object of the present invention is to provide a system and method for acquiring signals for change in physiological and emotional parameters of a person and the surrounding conditions and to convert those to a piece of music.

Another object of the present invention is to provide a system and method for converting an experience of a user into a piece of music.

A further object of the present invention is to provide a system and method for converting an experience of a user into a piece of music mixed with a track being listened to by the user during the experience.

Yet another object of the present invention is to provide a system and method for converting an experience of a user into a piece of music in real time.

A further object of the present invention is to provide a system and method for converting an experience of a user into a piece of music which can be customized by the user.

A still further object of the present invention is to provide a system and method for converting an experience of a user into a piece of music which can be shared by the user with others.

SUMMARY OF THE INVENTION following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

The system and method of the present invention is directed to creation of a piece of original music based on physiological and environmental parameters acquired through sensors. The sensors can be any sensors wearable and non-wearable. The sensors can be those included in smart phones or smart watches such as accelerometer, photo sensors, microphone etc. The sensors can also include, but not limited to, heart beat sensors, temperature sensors, blood pressure sensors, gyroscope, pedometer etc. The sensors acquire the physiological and surrounding environmental parameters of a user and send those data to a computing device, for example, to a smart phone, through wired or wireless communication means. The different modules present in the computing device then analyze and convert the acquired data sets to a piece of music. Since, the acquired set of data through sensors capture the physiological and environmental parameters of a user during an activity of the user, the acquired data sets reflect the kind of experience the user is having at a particular moment and, thus, the music created based on these data sets represent the emotional and physiological state of a person during an experience. Listening to the created piece of music by the user during or after an experience helps the user remember the experience and thus the created piece of music becomes a musical memory. The present invention allows the user to modify/change the way the music is created before, during and after data acquisition through a user interface. The creation of music can be done in real time and the created music can be stored. The present invention also allows sharing of the created music with others in social media.

To the accomplishment of the foregoing and related ends, certain illustrative aspects of the disclosed invention are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

In order to describe the manner in which features and other aspects of the present disclosure can be obtained, a more particular description of certain subject matter will be rendered by reference to specific embodiments which are illustrated in the appended drawings. Understanding that these drawings depict only typical embodiments and are not therefore to be considered to be limiting in scope, nor drawn to scale for all embodiments, various embodiments will be described and explained with additional specificity and detail through the use of the accompanying drawings in which.

DETAILED DESCRIPTION OF THE INVENTION

The following description is presented to enable any person skilled in the art to make and use the invention, and is provided in the context of particular applications of the invention and their requirements. Various modifications to the disclosed embodiments will be readily apparent to those skilled in the art and the general principles defined herein may be applied to other embodiments and applications without departing from the scope of the present invention. Thus, the present invention is not intended to be limited to the embodiments shown, but is to be accorded the widest scope consistent with the principles and features disclosed herein.

In the following detailed description, numerous specific details are set forth in order to provide a thorough understanding of the invention. However, it will be understood by those skilled in the art that the present invention may be practiced without these specific details. In other instances, well-known methods, programmes, algorithms, procedures and components have not been described in detail so as not to obscure the present invention.

Figure 1:
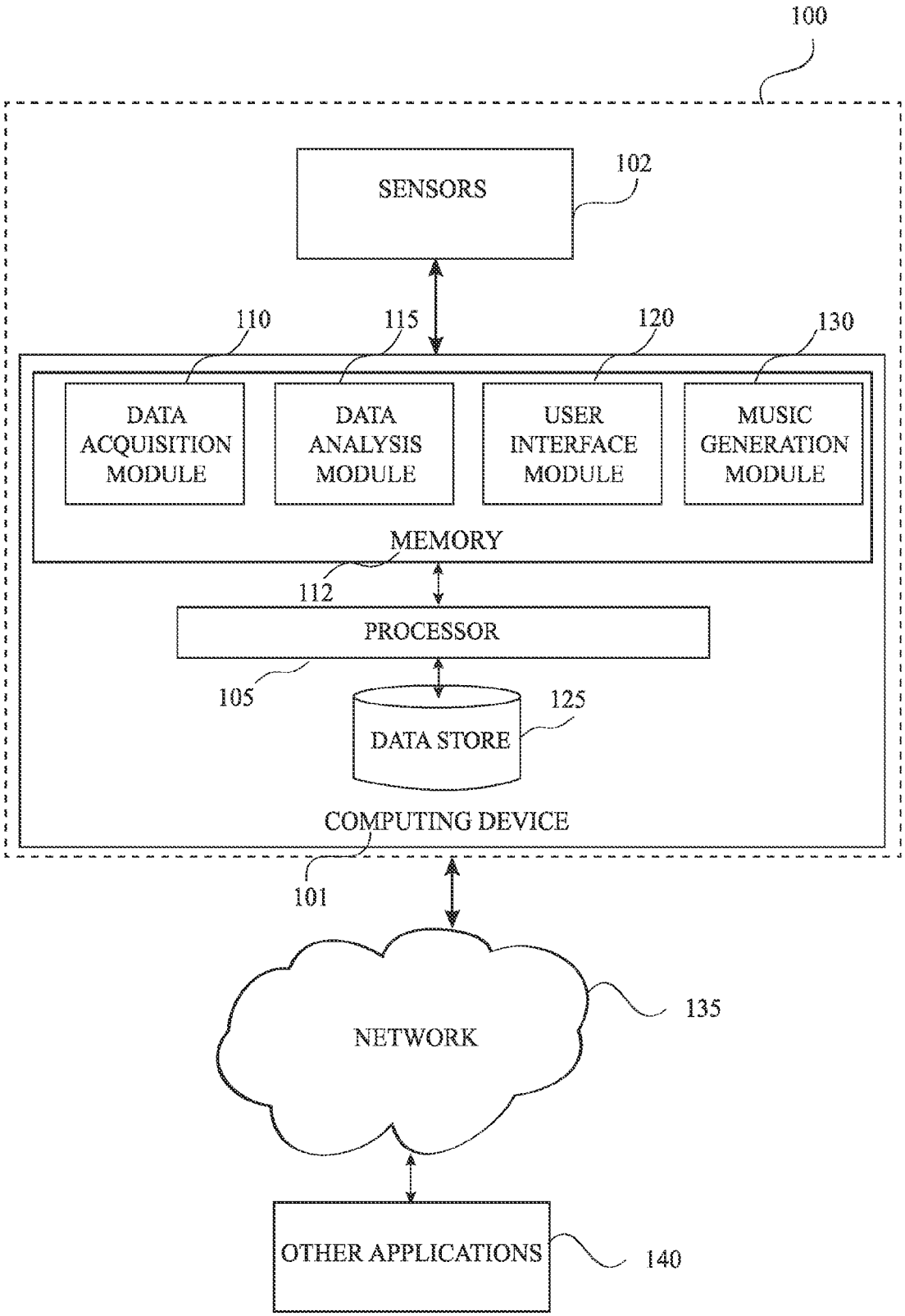
FIG. 1 shows a high level block diagram of a music generating system that operates in accordance with one embodiment of the present invention.

FIG. 1 shows a high level block diagram of a music generating system 100 according to a preferred embodiment of the present invention along with an exemplary network 135 for connecting the system 100 to other applications 140 such as social media. The music generating system 100 includes a computing device 101 and one or more sensors 102. The one or more sensors 102 may include, but not limited to, any sensors such as photo sensors, microphones, accelerometers, gyroscope, temperature sensors, compass, pulse monitor, infrared and ultrasound sensors etc. The one or more sensors 102 may be those included in smartphones or in other similar mobile devices or may be any wearable and non-wearable sensor. However, hereinafter the present invention is described with reference to sensors included in mobile computing devices and wearable sensors.

The computing device 101 shown in FIG. 1 may include, but not limited to, any mobile computing device such as smart phones, tablets, laptops etc. or any other computing device such as desktop computer, server computer, main frame computer etc. However, it should be obvious to any person having skill in the art that the system and method presented herein are not inherently related to any particular computer or other apparatus. Various general purpose systems may be used with programs and algorithms in accordance with the teachings herein, or it may prove convenient to construct a more specialized apparatus to perform the desired method. The desired structure for a variety of these systems will appear from the description below. In addition, embodiments of the present invention are not described with reference to any particular programming language or algorithms. It will be appreciated that a variety of programming languages and algorithms may be used to implement the teachings of the inventions as described herein. Computer program and algorithms in the present context mean any expression, in any language, code or notation, of a set of instructions intended to cause a system having an information processing capability to perform a particular function.

Reference to FIG. 1, the computing device 101 comprises a memory 112, a data store 125 and a processor 105. The memory 112, which is a non-transitory computer readable storage media, according to a preferred embodiment of the present invention, stores a protocol software containing one or more instructions, which, when executed by one or more processors (such as by processor 105), causes the one or more processors to perform steps for processing instructions transmitted/received to/from a communication network, an operating system, a control program for controlling the overall operation of the computing device 101, and applications. Particularly, the memory 112 includes a data acquisition module 110, a data analysis module 115, a user interface module 120 and a music generation module 130. Preferably, the memory 112 additionally stores a screen setup program for displaying application items through a user interface, which have been designated as the music generating application, on the display connected to or built-in with the computing device.

In general, the word "module", as used herein, refers to logic embodied in computing or firmware, or to a collection of software instructions, written in a programming language, such as, JAVA, C, or assembly or any other compatible programming language depending on the operating system supported by the computing device 101. One or more software instructions in the modules may be embedded in firmware, such as in an erasable programmable read only memory (EPROM). The modules described herein may be implemented as either software and/or computing modules and may be stored in any type of non-transitory computer-readable medium or other storage device. Some non-limiting examples of non-transitory computer-readable media include CDs, DVDs, BLU-RAY, flash memory, and hard disk drives.

The data store 125 according to a preferred embodiment of the present invention usually acts as a data buffer when the computing device 101 runs a program. The data store 125 temporarily stores data input by the user. In addition, the data store 125 stores other pieces of data, including different soundtracks/families of music and preferences received by the computing device from the outside.

The processor 105 according to a preferred embodiment of the present invention controls the overall operation of the computing device 101. Particularly, when the music generation system 100 is activated, the processor 105 reads the signal and outputs a music generation program, according to the program of one or more instructions stored in the memory 112, to the data store 125. Then, the program is run. The processor 105 loads a first application, which has been designated, onto the data store 125 in accordance with the program and controls the activation and data acquisition from one or more sensors 102. Thereafter, as per the user setting or default setting, the processor 105 loads the next application, which has been designated as the music generation program, onto the data storage module. Similarly, the processor 105 controls the inter-communication and functioning of the other modules included in the computing device 101 to accomplish the method of music generation of the present invention.

The one or more sensors 102 and computing device 101 may communicate with each other through wired connection or through any wireless communication such as through use of Bluetooth.

Figure 2:
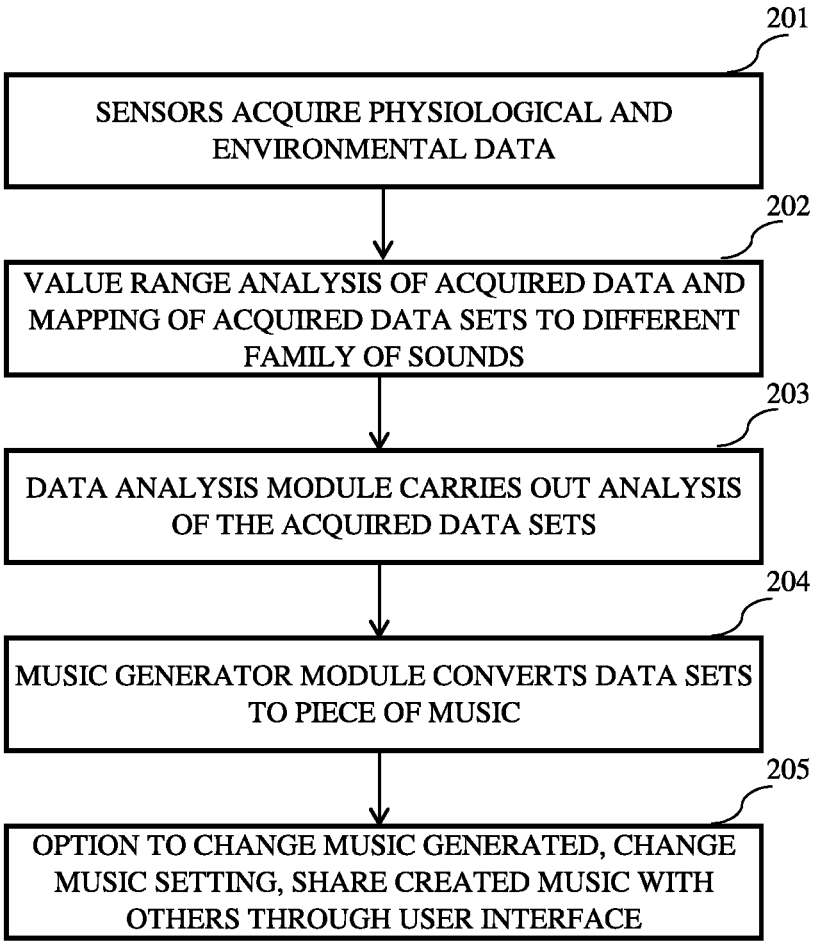
FIG. 2 is a flow diagram illustrating a method for creating a piece of music in accordance with one embodiment of the present invention.

Reference to FIG. 1 and FIG. 2, for the purpose of explanation, the present invention is described herein with reference to an example of a person carrying a smart phone i.e. a mobile computing device 101 with built-in photo sensor (in the form of the built-in camera) and a microphone. The person is also assumed to be wearing a smartwatch with built-in sensors such as heart beat sensors, gyroscope and accelerometer which can transmit the biophysical/physiological and kinematic data in real time to the computing device 101 through wireless communication. Thus, with these sensors 102 it is possible to capture some of the physical parameters of the person and also some of the environmental parameters surrounding the person.

The music generating system 100 can be activated in several ways: manually by the user (hereinafter the person of our example will be referred to as user), when he/she wants to start recording the experience; by scheduling, if the user wants to plan an acquisition in his/her phone calendar or he/she wants to repeat it with a fixed scheduling; by event, if the user wants to set the one or more sensors 102 and one or more thresholds, every time thresholds of the set sensors are reached, the data acquisition starts. The duration of data acquisition through the sensors 102 can be for a preset time or for a time period decided by the user.

In the present example, as in step 201 of FIG. 2, when the music generating system 100 is activated, the sensors 102 described above start recording the heart beat data of the user (through heart beat sensors included in smart watch), movement data of the user (through accelerometer and gyroscope included in smart watch), light data of the user's surrounding environment (through activated smart phone camera) and the sound level data of the user's surrounding environment (through activated microphone of the smart phone). The data acquired through the sensors of the smart watch are transmitted to the smartphone (i.e. computing device 101) of the user wirelessly in the present example through Bluetooth or through wired means. The data acquisition module 110 of the computing device 101 reads and keeps track of every data set acquired through the sensors 102.

As in step 202, the data analysis module 115 then starts analyzing the acquired data. The data analysis module 115 maps every set of data acquired to a specific family of sound. But, before mapping, the value ranges of each of the data sets are analyzed as the value ranges have to be similar for every acquired data set. So, the values of the acquired data sets are multiplied, if required, by the data analysis module 115 so as to make the value ranges of data sets made similar to each other. Once normalized, the data sets are assigned or mapped to different families or groups of sounds. For example, the data set acquired from the signals of heart beat sensors may be mapped to a family of instrument sounds (e.g. bass guitar sounds) and on a music scale (like a pentatonic scale or a major scale) or on a non instruments family (like sounds of wind or sound from animals) etc. In the preferred embodiment, a user can choose the category of instrument or scale for the mapping. Selections may be made so that each sensor has its own sound, or so that one or more may use the same sound(s). Family of sounds can be selected from, but are not limited to, gliding tone instruments, melody instruments, rhythm grid instruments, and groove file instruments. These are merely examples and the present invention is not limited only to these instruments and timbres. The present invention also contemplates that the sound files could include, but are not limited to, sirens, bells, screams, screeching tires, animal sounds, sounds of breaking glass, sounds of wind or water, and a variety of other kinds of sounds. It is an additional aspect of the preferred embodiment that those sound files may then be selected and manipulated further by a user through selections made in the user interface provided by the user interface module 120.

Once a category/family of sound is selected, the user can then select a specific scale and beat to customize the type of music the computing device 101 will create in response to signals received from the sensors 102. This could be done by the user selecting his actual state of mind to orientate the creation of a piece of music to make it as close as possible to his emotional state. It is envisioned that steps may be combined, added or removed, and that other default settings may be programmed in.

The collection of quantitative data of the acquired signals are evenly spaced in time and measured successively by the data analysis module 115 in time-series analysis. The objectives of the time-series analysis are to identify patterns in correlated data—trends and variation, to understand and model the data and to find out deviations from a specified size indicated. Time-series analysis allows a mathematical model to be developed which enables monitoring and control of the data sets. In the context of the present invention, time-series analysis will perform data analysis process to understand if there is regularity in the acquisition time-stamps, if there is periodicity in the data sets, if there are some points of accumulation of similar values, if there are some periods of zero values or no data acquisition and so on.

The data analysis module 115 also carries out frequency analysis of the acquired data sets to find out the frequency characteristics. Analysis in the frequency domain is often used for periodic and cyclical observations. Common techniques are spectral analysis, harmonic analysis, and periodogram analysis. A specialized technique is fast Fourier Transform (FFT) that can be used in the present invention. It would be obvious to any person skilled in the art that any compatible algorithms known in the art for time-series analysis and frequency analysis can be used to accomplish the objectives of the present invention.

In case of the present example, if the user is engaged in an activity like dancing during acquisition of the data sets through the sensors 102, as in step 203, the data analysis module 115 would carry out time-series analysis and frequency analysis on the data sets. For instance, suppose the data set acquired from the accelerometer worn by the user is mapped, by default or by user setting, to a minor scale of a family of sound like that of a violin. In this case, if data analysis module 115, through time-series analysis, finds out that there are two beat discontinuities in the data sets (suppose, for example, due to different movement of the user during the dance steps), then the data are not processed like a single data set with an average beat value, but the data set is separated in three main time parts and for every part a homogeneous beat is determined. Suppose the data analysis module 115 also finds through frequency analysis that the most of the energy of the data set lies around just one main frequency then, a music track of violin beat with minor scale will be created that is built by three periods each with regular but different beats. In the present example, the maximum value of the data set minus the minimum value of the data set is subdivided in eight range values in a octave, and, each range, from the first to the eighth, is assigned to a note of the minor scale of violin sound track as the frequency analysis of the data set found only one major frequency domain. Overall, the data analysis module 115 may be configured to analyze various musical attributes such as spectrum, envelope, modulation, rise and decay time, noise, etc.

As a result of the above mentioned steps, the computing device 101 would now have different pieces of music sets as per the data sets acquired from the various sensors; all data sets preferably mapped to different families of sounds. Thereafter, as in step 204, all the music sets are merged to form a single piece of music by the music generation module 130. The music generation module 130 would analyze the regularity of the beats of the final music set and, if it is necessary, the music generation module 130 would re-arrange the merger of individual music sets to avoid out of rhythm parts. The music generation module 130 would also analyze the harmony of the final music set and, if it is necessary, it would arrange to avoid the disharmonic parts in the final piece of music. Also, the music generation module 130 analyzes the regularity of the volume of the final music set and, if it is necessary, it arranges to avoid volume bounces. The above mentioned steps applied for correction of sync, harmonization and rhythm are indicative only and, it would be obvious to any person skilled in the art that any other algorithm may be applied for correction of the final set of music to make it pleasant to the ears of a listener.

In a preferred embodiment, as in step 205, the computing device 101 also makes it possible for the user, through the user interface, to have control over the final piece of music generated. Some of the examples of options offered to the user through the user interface are, but not limited to, to allow selection of tracks, merge the different sets of music in various orders, add or delete one or more music set for the creation of final piece of music, change the family of sound, scale, beat, volume etc. The user can also add and store his/her own music tracks and sound libraries in the data store 125 for use in creation of music through the music generating system 100. In other words, the user interface provided by the user interface module 120 allows the user to have complete control to change the parameters before and after data acquisition through the sensors 102 and alter the way the various steps are carried out by the computing device 101 to finally produce a piece of music which can capture the experience of the user in terms of physiological and surrounding environments states of the user during the period of recording.

In a preferred embodiment, the present invention also enables a user to share the experience he/she had during an event (for example dancing in the present case) in the form of the piece of music created by the system and method of the present invention with others by sharing it with other applications such as with social media through the network 135. As used herein, the term "network" generally refers to any collection of distinct networks working together to appear as a single network such to a user. The term refers to the so-called world wide "network of networks" i.e. Internet that is connected to each other using the Internet protocol (IP) and other similar protocols. As described herein, the exemplary public network 135 of FIG. 1 is for descriptive purposes only and the concept equally applies to other public and private computer networks, including systems having architectures dissimilar to that shown in FIG. 1.

In another preferred embodiment, the computing device 101 would also analyze the emotional state of the user through analysis of the acquired data and suggest, according to the emotional state of the user, his/her a version of the music with a different genre/tempo like "adagio" or "allegro" or "andante" etc. The computing device 101 is also able to scan its data store 125 and find out the music stored which were generated from similar data sets in the past corresponding to similar kind of experience went through the user. That implies, the computing device 101 would be able to tell the user the kind of similar experience happened to the user before based on the analysis of the acquired physiological and environmental data sets.

It is also envisioned that the whole process, starting from data acquisition to analysis and conversion of data sets to final piece of music, can be accomplished in real time so that a user can listen to "live" music based on the kind of experience the user is having at that moment in accordance to the system and method described herein for the present invention.

Also, the present system and method would allow the user to record an audio and/or video segment at the same time of the moment recorded to contribute to complete the experience recording, to have the piece of music created, together to audio or video recorded.

In some embodiments, the present invention also deals with the process of use of the data acquired to modify/create/apply effects on images or videos. Starting from a database of images or videos, or from the user library, the process can modulate/stretch/change every parameter of the video or of the image in accordance with every data set acquired by each sensor.

As evident from the above description, through the system and method of the present invention, it becomes possible for a person to record any kind of experience he/she is having and create a piece of music to match the physiological, emotional and also surrounding environmental states of the user during that period of experience. Thus, the created music, when listened to, helps a person to relive the experience. When a person listens live to an original piece of music created by the system and method described by the present invention with respect to the experience going through the user or listens to that music just after having the experience, it helps the user to remember the experience for a long time and, whenever he/she listens to that music again on a later date, the music can remind the user the kind of experience the user had during the recording of the signals.

It is envisioned that the present invention would also enable data acquisition related to a mental state or emotional state of a person through brain scanning and then conversion of those data into a piece of music to capture the emotional state of the person during an event.

Additionally, although aspects of the present invention has been described herein using a stand-alone computing system, it should be apparent that the invention may also be embodied in a client-server like computer system.

Flowchart is used to describe the steps of the present invention. While the various steps in this flowchart are presented and described sequentially, some or all of the steps may be executed in different orders, may be combined or omitted, and some or all of the steps may be executed in parallel. Further, in one or more of the embodiments of the invention, one or more of the steps described above may be omitted, repeated, and/or performed in a different order. In addition, additional steps, omitted in the flowchart may be included in performing this method. Accordingly, the specific arrangement of steps shown in FIG. 2 should not be construed as limiting the scope of the invention.

Additionally, other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A music generating system, said system comprising:

one or more sensors configured to acquire one or more data sets related to physiological and environmental condition of a user; and a computing device, said computing device comprising:

a processor; and a memory storing instructions that, when executed by said processor, configure said computing device to:

read, by a data acquisition module, said one or more data sets received from said one or more sensors;

perform, by a data analysis module, a value range analysis of said one or more data sets received to normalize said one or more data sets;

map, with the help of said data analysis module, each of said normalized one or more data sets to one or more families of sounds stored in a data store;

create, by said data analysis module, a plurality of individual music pieces on the basis of a time series analysis and a frequency analysis of said each of said normalized one or more data sets mapped to said one or more families of sounds; and merge, by a music generation module, said plurality of individual music pieces to create a final piece of music.

2. The music generating system as in claim 1, wherein said music generating system is activated automatically when a value of said one or more data sets acquired by said one or more sensors reaches a preset threshold value.

3. The music generating system as in claim 1, wherein said mapping of said each of said normalized one or more data sets to said one or more families of sounds is done as per a selection made by said user through a user interface provided by a user interface module on a display.

4. The music generating system as in claim 3, wherein said selection includes selection of category of sound, scale and beat of music.

5. The music generating system as in claim 1, wherein said families of sounds include instrument sounds and non-instrument sounds.

6. The music generating system as in claim 1, wherein said time series analysis determines if there is irregularity, periodicity and points of accumulation of similar values in said each of said normalized one or more data sets mapped to said one or more families of sounds, and, accordingly, said each of said normalized one or more data sets are divided into a plurality of data parts and each of said plurality of data parts is assigned with individual homogeneous beat values.

7. The music generating system as in claim 6, wherein said frequency analysis determines frequency characteristics of said plurality of data parts to assign one or more notes of same or different scale values.

8. The music generating system as in claim 1, wherein process of said merging by said music generation module includes correction of sync, harmonization, rhythm and volume of said final piece of music.

9. The music generating system as in claim 3, wherein said user interface enables said user to have control over said acquisition of one or more data sets, said reading of said one or more data sets, said creation of said plurality of individual music pieces and said merging of said individual music pieces to create said final piece of music.

10. The music generating system as in claim 1, wherein said computing device is configured to analyze an emotional state of said user based on analysis of said one or more data sets and, based on said emotional state, suggests a version of genre of music corresponding to said emotional state.

11. The music generating system as in claim 1, wherein said final piece of music is generated in real time corresponding to said acquisition of said one or more data sets.

12. The music generating system as in claim 1, wherein said computing device is configured to find out from a database of a plurality of said final piece of music, stored in said data store, generated from earlier experiences of said user, similar experience happened to said user based on analysis of said one or more data sets.

13. The music generating system as in claim 1, wherein said computing device is configured to mix said final piece of music with an audio or video being played or recorded on said computing device during acquisition of said one or more data sets.

14. A method for music generation in a system, said system comprising one or more sensors configured to acquire one or more data sets related to physiological and environmental condition of a user and a computing device, said computing device comprising a processor and a memory storing instructions that, when executed by said processor, configure said computing device to generate a final piece of music, said method comprising:

reading, by a data acquisition module, said one or more data sets received from said one or more sensors;

performing, by a data analysis module, a value range analysis of said one or more data sets received to normalize said one or more data sets;

mapping, with the help of said data analysis module, each of said normalized one or more data sets to one or more families of sounds stored in a data store;

creating, by said data analysis module, a plurality of individual music pieces on the basis of a time series analysis and a frequency analysis of said each of said normalized one or more data sets mapped to said one or more families of sounds; and merging, by a music generation module, said plurality of individual music pieces to create said final piece of music.

15. The method as in claim 14, wherein said mapping of said each of said normalized one or more data sets to said one or more families of sounds is done as per a selection made by said user through a user interface provided by a user interface module on a display.

16. The method as in claim 15, wherein said selection includes selection of category of sound, scale and beat of music.

17. The method as in claim 14, wherein said time series analysis determines if there is irregularity, periodicity and points of accumulation of similar values in said each of said normalized one or more data sets mapped to said one or more families of sounds, and, accordingly, said each of said normalized one or more data sets are divided into a plurality of data parts and each of said plurality of data parts is assigned with individual homogeneous beat values.

18. The method as in claim 17, wherein said frequency analysis determines frequency characteristics of said plurality of data parts to assign one or more notes of same or different scale values.

19. The method as in claim 14, wherein process of said merging by said music generation module includes correction of sync, harmonization, rhythm and volume of said final piece of music.

20. The method as in claim 14, wherein said final piece of music is generated in real time corresponding to said acquisition of said one or more data sets.

* * * * *